US009044766B2

(12) United States Patent
Anderton et al.

(10) Patent No.: US 9,044,766 B2
(45) Date of Patent: Jun. 2, 2015

(54) SPRAY HEAD FOR A MOBILE FLUID DISTRIBUTION SYSTEM

(75) Inventors: Peter William Anderton, Peoria, IL (US); Landon Lee Rowell, Tremont, IL (US); Apostolis Kouvelis, Lalor (AU); Christopher Lee Hyatt, Dunlap, IL (US); Balamurugesh Thirunavukarasu, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 246 days.

(21) Appl. No.: 13/614,067

(22) Filed: Sep. 13, 2012

(65) Prior Publication Data

US 2014/0070027 A1 Mar. 13, 2014

(51) Int. Cl.

| | |
|---|---|
| ***B05B 1/04*** | (2006.01) |
| ***B05B 1/20*** | (2006.01) |
| ***B05B 12/12*** | (2006.01) |
| ***E01H 3/02*** | (2006.01) |
| ***B05B 1/26*** | (2006.01) |
| ***B05B 11/00*** | (2006.01) |
| ***B05B 12/08*** | (2006.01) |
| ***B05B 13/00*** | (2006.01) |

(52) U.S. Cl.

CPC . *B05B 1/26* (2013.01); *B05B 1/044* (2013.01); *B05B 11/3088* (2013.01); *B05B 12/085* (2013.01); *B05B 12/126* (2013.01); *B05B 13/005* (2013.01)

(58) Field of Classification Search

CPC ..... B05B 1/04; B05B 1/044; B05B 1/048; B05B 1/30; B05B 1/3026; B05B 1/3033; B05B 1/3073; B05B 1/308; B05B 13/005; B05B 1/26; B05B 12/085; B05B 12/126; E01H 3/02; E01H 10/005; E01H 10/007

USPC ..... 239/146, 155–157, 164, 172, 456, 498, 239/500, 518, 521–524, 583, 586, 590.5, 239/592, 597, 598

See application file for complete search history.

(56) References Cited

U.S. PATENT DOCUMENTS

| | | | |
|---|---|---|---|
| 622,547 | A | 4/1899 | Shedlock et al. |
| 2,031,262 | A | 2/1936 | Hill, Jr. |
| 3,100,083 | A | 8/1963 | Wardrup |
| 3,344,993 | A | 10/1967 | Walder et al. |
| 3,529,772 | A | 9/1970 | Brodersen |
| 3,552,658 | A | 1/1971 | Sons |
| 3,782,634 | A | 1/1974 | Herman |
| 3,853,272 | A | 12/1974 | Decker et al. |
| 4,052,003 | A | 10/1977 | Steffen |
| 4,167,247 | A | 9/1979 | Sons et al. |
| 4,519,542 | A | 5/1985 | Johnston |
| 4,676,435 | A | 6/1987 | Nesland |
| 4,685,545 | A | 8/1987 | Fannin et al. |

(Continued)

*Primary Examiner* — Darren W Gorman

(74) *Attorney, Agent, or Firm* — Miller, Matthias & Hull LLP

(57) ABSTRACT

A spray head for a fluid distribution system may include first and second deflector inner surfaces defining a fluid outlet. A piston may define a variable orifice communicating with the fluid outlet to control fluid flow through the spray head. An inner surface of the second deflector may define a grooveless deflector central region disposed between first and second deflector lateral regions. Each of the first and second deflector lateral regions may include at least a first deflector groove extending along a first deflector groove path oriented substantially radially relative to the inlet passage, so that the spray head generates a spray pattern having more uniform fluid distribution across the spray pattern.

20 Claims, 8 Drawing Sheets

(56) References Cited

U.S. PATENT DOCUMENTS

| | | | |
|---|---|---|---|
| 4,803,626 | A | 2/1989 | Bachman et al. |
| 4,817,870 | A | 4/1989 | Dalton |
| 5,076,497 | A | 12/1991 | Rabitsch |
| 5,134,961 | A | 8/1992 | Giles et al. |
| 5,522,543 | A | 6/1996 | Herzog |
| 5,618,022 | A | 4/1997 | Wallace |
| 5,911,362 | A | 6/1999 | Wood et al. |
| 5,911,363 | A | 6/1999 | Oligschlaeger |
| 5,964,410 | A | 10/1999 | Brown et al. |
| 5,988,535 | A | 11/1999 | Kime |
| 6,068,200 | A | 5/2000 | Kime |
| 6,102,306 | A * | 8/2000 | Ask et al. ..... 239/201 |
| 6,119,955 | A | 9/2000 | Starr |
| 6,382,523 | B1 | 5/2002 | Hedegard |
| 6,446,879 | B1 | 9/2002 | Kime |
| 6,454,183 | B1 | 9/2002 | Hedegard |
| 6,938,829 | B2 | 9/2005 | Doherty et al. |
| 7,108,196 | B2 | 9/2006 | Kime |
| 7,182,278 | B2 | 2/2007 | Haviland et al. |
| 7,370,818 | B2 | 5/2008 | Ward |
| 2006/0273189 | A1 | 12/2006 | Grimm et al. |
| 2010/0301134 | A1 | 12/2010 | Anderton et al. |
| 2011/0220736 | A1 | 9/2011 | Anderton et al. |

* cited by examiner

SPRAY HEAD FOR A MOBILE FLUID DISTRIBUTION SYSTEM

TECHNICAL FIELD

The present disclosure is directed to systems and methods for fluid distribution and, more particularly, to systems and methods for controlled distribution of a fluid in a mobile environment. More specifically, this disclosure relates to spray head components of such systems.

BACKGROUND

Fluid distribution systems, in particular mobile fluid distribution systems, are used in a variety of applications. For example, at mining and construction sites, it is common to use mobile fluid distribution systems to spray water over routes and work areas to minimize the creation of dust during operations. A specific example might include a water truck that sprays water over roads at a mine site. Other applications of mobile fluid distribution systems may include spraying of pesticides and herbicides, e.g., for agricultural use, disbursement of saline solutions on roads for snow and ice control, fire suppression, and the like.

For various reasons, such as cost and consistent fluid application, it is desired to control of the amount and pattern of fluids being distributed, in particular with regard to maintaining a uniform and consistent application of fluid per unit of area. For example, when spraying water on mine roads, it may be desired to uniformly distribute the water over the road surface to avoid applying excess water in specific locations. In particular, it is desired to provide a spray head capable of distributing fluid in a consistently wide spray. The desire is to provide consistent spray patterns in areas, such as on inclines and at intersections, where flow rates may be decreased due to decreased machine speed or the need to decrease the amount of fluid per unit area.

Efforts have been made to provide a more consistent spray pattern by maintaining a constant fluid pressure while varying the flow rate using individual spray heads, as disclosed in U.S. Patent Application Publication No. 2011/220736 to Anderton et al. While the approach described by Anderton et al. has resulted in substantial improvements in providing a consistent spray pattern, the mass flow of fluid may be concentrated in a center of the fluid outlet passage, thereby leading to sub-optimal spray coverage.

SUMMARY OF THE DISCLOSURE

In accordance with one aspect of the disclosure, a spray head for a fluid distribution system may include a base defining a fluid inlet passage extending along an inlet axis, a barrel coupled to the base and defining a barrel chamber extending along a barrel axis, a first deflector extending outwardly from the barrel and defining a first deflector inner surface, and a second deflector extending outwardly from the base and defining a second deflector inner surface, wherein the first and second deflector inner surfaces are disposed in opposed, spaced relation to define a fluid outlet passage. A piston may be slidably disposed in the barrel chamber and have a bottom surface, and an orifice may be defined between the piston bottom surface the second deflector inner surface and have a cross-sectional area that varies with piston position to control fluid flow from the fluid inlet passage to the fluid outlet passage. The second deflector inner surface may define a grooveless deflector central region disposed between first and second deflector lateral regions, each of the first and second deflector lateral regions including at least a first deflector groove extending along a first deflector groove path oriented substantially radially relative to the inlet passage.

In another aspect of the disclosure that may be combined with any of these aspects, a deflector may be provided for use with a fluid distributing spray head having a fluid inlet passage extending along an inlet axis and a fluid outlet passage extending substantially perpendicular to the inlet axis. The deflector may include a deflector inner surface, a grooveless deflector central region defined by the deflector inner surface, and first and second deflector lateral regions defined by the deflector inner surface and disposed on opposite sides of the deflector central region. At least a first deflector groove may be disposed in each of the first and second deflector lateral regions, each of the first deflector grooves extending along a first deflector groove path oriented substantially radially relative to the inlet passage of the spray head.

In another aspect of the disclosure that may be combined with any of these aspects, a spray head for a fluid distribution system may include a base defining a fluid inlet passage extending along an inlet axis, a barrel coupled to the base and defining a barrel chamber extending along a barrel axis, a first deflector extending outwardly from the barrel and defining a first deflector inner surface, a second deflector extending outwardly from the base and defining a second deflector inner surface, wherein the first and second deflector inner surfaces are disposed in opposed, spaced relation to define a fluid outlet passage, and a piston slidably disposed in the barrel chamber and having a bottom surface. An orifice may be defined between the piston bottom surface the second deflector inner surface and have a cross-sectional area that varies with piston position to control fluid flow from the fluid inlet passage to the fluid outlet passage. The second deflector inner surface may define a grooveless deflector central region disposed between first and second deflector lateral regions, each of the first and second deflector lateral regions including at least a first deflector groove extending along a first deflector groove path oriented substantially radially relative to the inlet passage. A fluid spray pattern defined by the spray head may include a central distribution zone associated with the deflector central region and having a central distribution zone flow index, a first lateral distribution zone associated with the first deflector lateral region and having a first deflector distribution zone flow index, and a second lateral distribution zone associated with the second deflector lateral region and having a second deflector distribution zone flow index. A maximum distribution variance between the central distribution zone flow index and the first and second deflector distribution zone flow indices may be less than approximately 10%.

DETAILED DESCRIPTION

Figure 1:
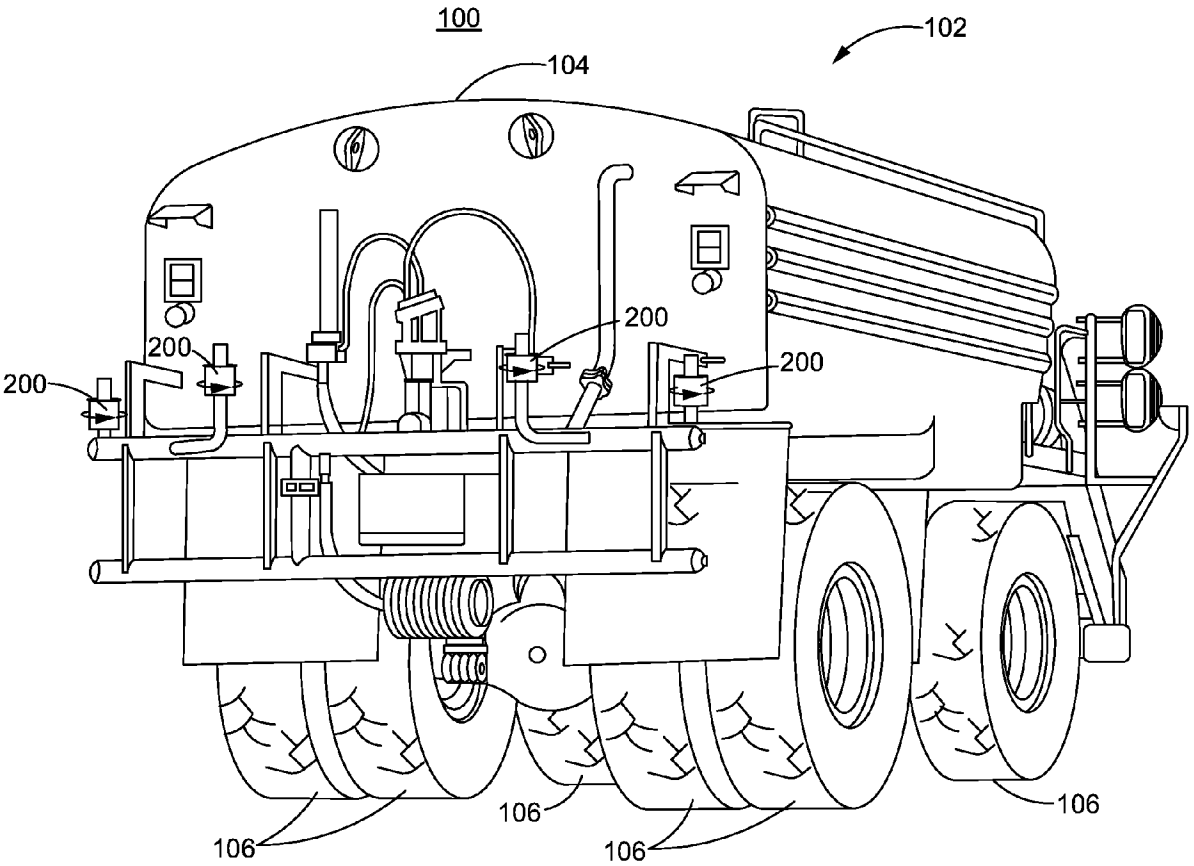
FIG. 1 is a diagrammatic illustration of a mobile machine suited for use with the present disclosure.

This disclosure relates to mobile fluid distribution systems and method for distributing fluids. FIG. 1 illustrates one embodiment of a mobile fluid distribution system 100 according to the present disclosure. The mobile fluid distribution system includes a mobile machine 102 configured to distribute fluids. The mobile machine 102 of FIG. 1 is shown as a truck, i.e., typical for use in off-highway applications, converted for use to distribute fluids. However, other types of mobile machines may be employed, for example, articulated trucks, on-highway trucks, tractor-scrapers, tractors in combination with trailers, and the like.

The mobile machine 102 may be fitted with a fluid tank 104 and a variety of piping, hoses, pumps and valves for fluid distribution purposes. In particular, the mobile machine 102 in FIG. 1 is shown as an off-highway truck configured as a water truck for spraying water at a work site that typically generates undesirable levels of dust during work operations. The present disclosure, however, may also apply to other types of mobile machines configured to distribute water or other types of fluids in a wide variety of applications. For example, a tractor pulling a trailer may be used to distribute chemicals in agricultural settings, an on-highway truck may be configured to spray a saline solution on roads, runways, or parking lots to melt snow and ice, and other varieties of applications and setups may be used.

Figure 2:
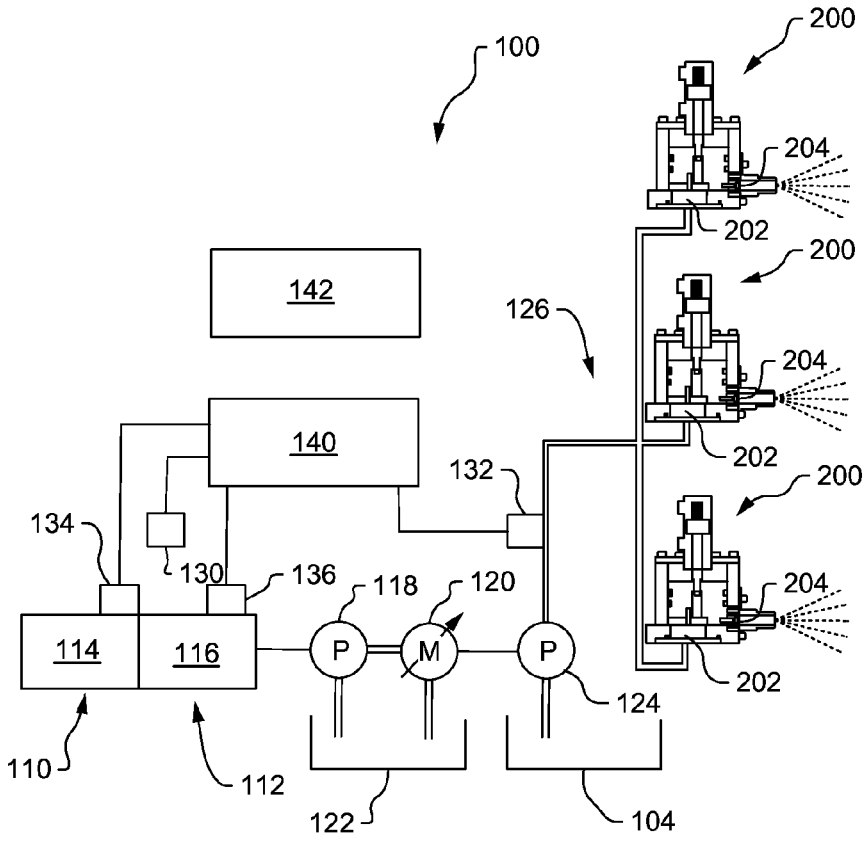
FIG. 2 is a schematic block diagram of a fluid distribution system.
Figure 3:
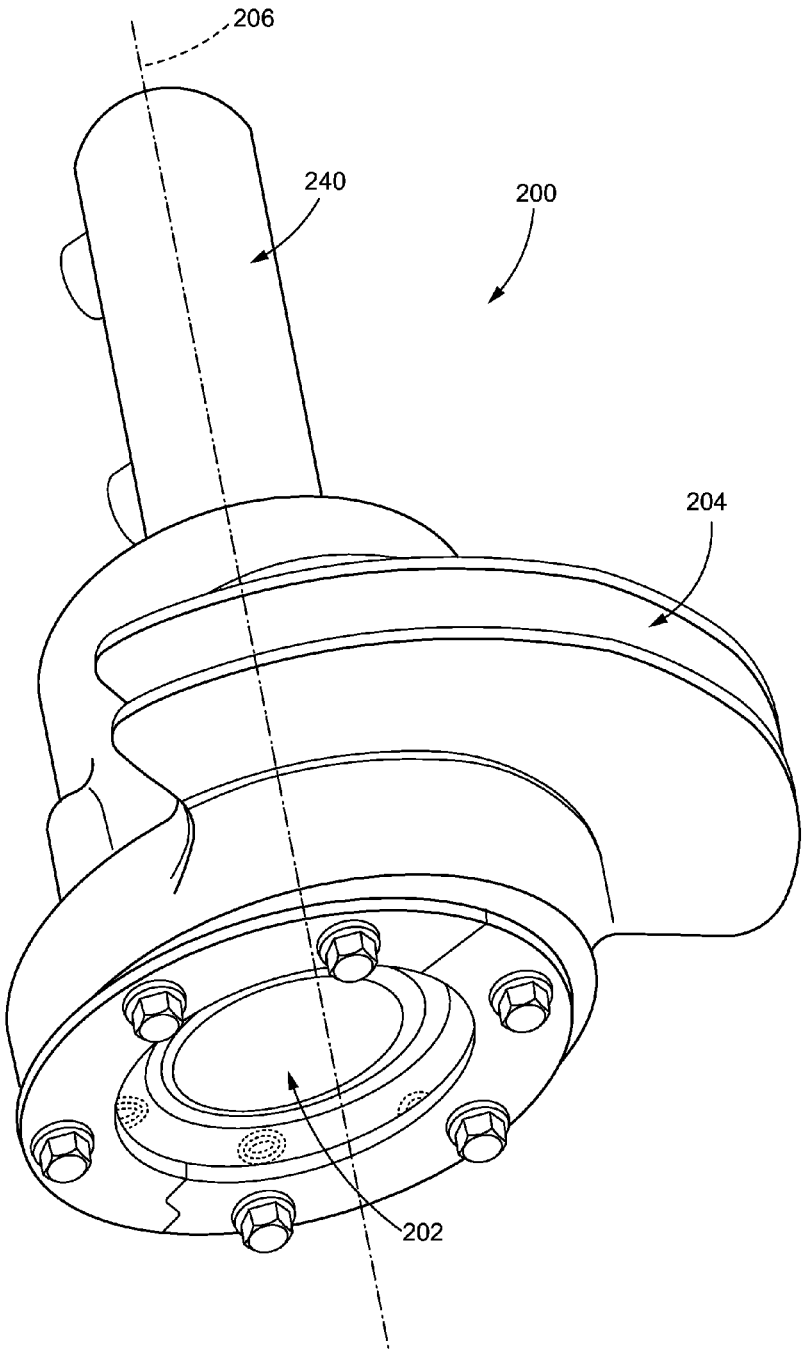
FIG. 3 is a perspective view of a spray head for use in the fluid distribution system of FIG. 2.

The fluid distribution system 100 is schematically illustrated in FIG. 2. For exemplary purposes, FIG. 2 is described as applied to a mobile machine 102, i.e., an off-highway truck, set up for use as a water truck at a mining or construction site, although the fluid distribution system 100 shown in FIG. 2 could be used in other applications as noted above.

A power source 110 may be configured to provide power to the fluid distribution system 100 as well as to supply motive power for the mobile machine 102. For example, the power source 110 may include a prime mover 112 for the mobile machine 102. The prime mover 112 may include an engine 114 drivingly connected to the mobile machine 102 and a transmission 116 driven by the engine 114. The engine 114 and transmission 116 may be chosen from among many types and configurations that are well known in the art. It is also well known to use the power supplied by prime mover 112 for other purposes in addition to providing motive power. For example, an off-highway truck, prior to being configured for water distribution applications, may have been designed to use power from the prime mover 112 for applications such as raising and lowering a truck bed.

A pump 118, driven by the power source 110, is in turn configured to drive a motor 120. The pump 118 may be driven by the engine 114 or the transmission 116 by means that are known in the art, and may be a hydraulic pump 118 as is also known in the art. The pump 118 may be configured to drive the motor 120 by well known hydraulic means. A hydraulic tank 122 may be used to supply and recover hydraulic fluid to and from the pump 118 and motor 120.

In the embodiment shown in FIG. 2, the pump 118 may be a fixed displacement type and the motor 120 may be variable displacement. For example, an off-highway truck configured for use as a water truck may have an existing fixed displacement pump 118 already in place for other purposes. Adding a variable displacement motor 120 may offer advantages in control of the fluid distribution system 100, for example by enabling control of fluid pressure to maintain the fluid at a constant desired pressure regardless of engine speed or ground speed. A fixed displacement pump 118 may still be used for applications other than fluid distribution without being affected by changes in fluid distribution parameters. For example, the pump 118 may drive the motor 120 and also drive a system for cooling brake components (not shown). The brake cooling system would not be affected by load changes from the fluid distribution system 100. In alternative embodiments, the pump 118 and motor 120 may be other combinations of fixed and variable displacement devices, for example a variable displacement pump and a fixed displacement motor.

The motor 120 is fluidly connected to one or more spray heads 200, e.g., three spray heads as shown in FIG. 2. More specifically, the motor 120 may provide hydraulic power to a fluid pump 124, which in turn delivers fluid by way of fluid lines 126 to an inlet passage 202 of each spray head 200. The fluid may flow through the spray heads 200 and discharge from outlet passages 204 configured to produce fluid spray patterns, as discussed in greater detail below. The fluid pump may obtain fluid from the fluid tank, such as the water tank 104 mounted on the mobile machine 102. Although the three spray heads 200 in FIG. 2 are shown connected by common fluid lines 126 to the fluid pump 124, each spray head 200 may be independently controllable.

The fluid distribution system 100 may include various sensors for measuring or otherwise determining an operating parameter associated with the system 100 and/or the mobile machine 102. For example, a ground speed sensor 130, may be configured to sense a ground speed as the machine moves. The ground speed sensor 130 may be located to sense ground speed based on operation of the transmission 116, rotational movement of a ground engaging member such as a wheel 106 (FIG. 1), or by some other method known in the art. A fluid pressure sensor 132 may be configured to sense pressure of fluid in fluid lines 126, or alternatively fluid pressure exiting fluid pump 124. An engine speed sensor 134 may be configured to sense the speed of the engine 114. A transmission state sensor 136 may be located to sense the state, e.g., forward, neutral, or reverse, of the transmission 116. The transmission state sensor 136 may alternatively sense direction of motion of the mobile machine 102 to determine transmission state. Any of the above sensors may be configured to directly sense a desired parameter, may sense one or more secondary parameters and derive a value for the desired parameter, or may determine a value for the desired parameter by some other indirect means. Operation of the above sensors for their intended purposes are well known in the art and will not be described further.

A controller 140 may receive sensed or derived signals from the ground speed sensor 130, the fluid pressure sensor 132, the engine speed sensor 134, and the transmission state sensor 136. The controller 140 may also be controllably connected to one or more of the engine 114 and the spray heads 200. For example, the controller 140 may use information received from the ground speed sensor 130 and the fluid pressure sensor 132 to determine a desired fluid pressure to maintain, and responsively control the variable displacement of the motor 120 to maintain a constant fluid pressure. The controller 140 may also use information received from the engine speed sensor 134 for further control of the variable displacement motor 120. The controller 140 may also use the above received information to operate the spray heads 200 to control a flow rate of the fluid being delivered to and sprayed from the spray heads 200. In one specific example, the controller 140 may determine from the transmission state sensor 136 if the mobile machine 102 is moving in reverse, and responsively shut off the fluid distribution system 100 during this condition.

An operator control device 142, located in a cab compartment (not shown) of the mobile machine 102, may provide an operator with a variety of control and display functions for the fluid distribution system 100. The operator control 142 may be of any desired configuration and may be custom designed for specific mobile machines and applications.

Turning to FIGS. 3-6, a spray head 200 is shown according to the present disclosure. The spray head 200 may be assembled in relation to a longitudinal axis 206 for reference purposes, and may include the fluid inlet passage 202 and the fluid outlet passage 204 noted above. The outlet passage 204 may be located at a position offset from the longitudinal axis 206 (FIGS. 5 and 6), and the inlet passage 202 may be located at a position offset from the longitudinal axis 206 and in a direction opposed to the location of the outlet passage 204. The location of the inlet passage 202 relative to the location of the outlet passage 204, i.e., on opposite sides of the longitudinal axis 206, may contribute to providing a laminar flow of fluid from the spray head 200. Such laminar flow may result in a flat spray pattern having droplets of a minimal size large enough to achieve reduced atomization of the fluid. In a water truck example, this may contribute to optimal fluid control from the spray head 200 to a desired surface during mobile spraying.

The spray head 200 may include a barrel 208 extending along a barrel axis 210. In the illustrated embodiment, the barrel axis 210 is substantially coincident with the longitudinal axis 206. A first deflector 212 extends outwardly from the barrel 208 to define a first deflector inner surface 214. In the illustrated embodiment, the first deflector 212 is formed integrally with the barrel 208, however the deflector 212 may be formed separately and subsequently coupled to the barrel 208. The barrel 208 may also define a barrel chamber 216.

Figure 5:
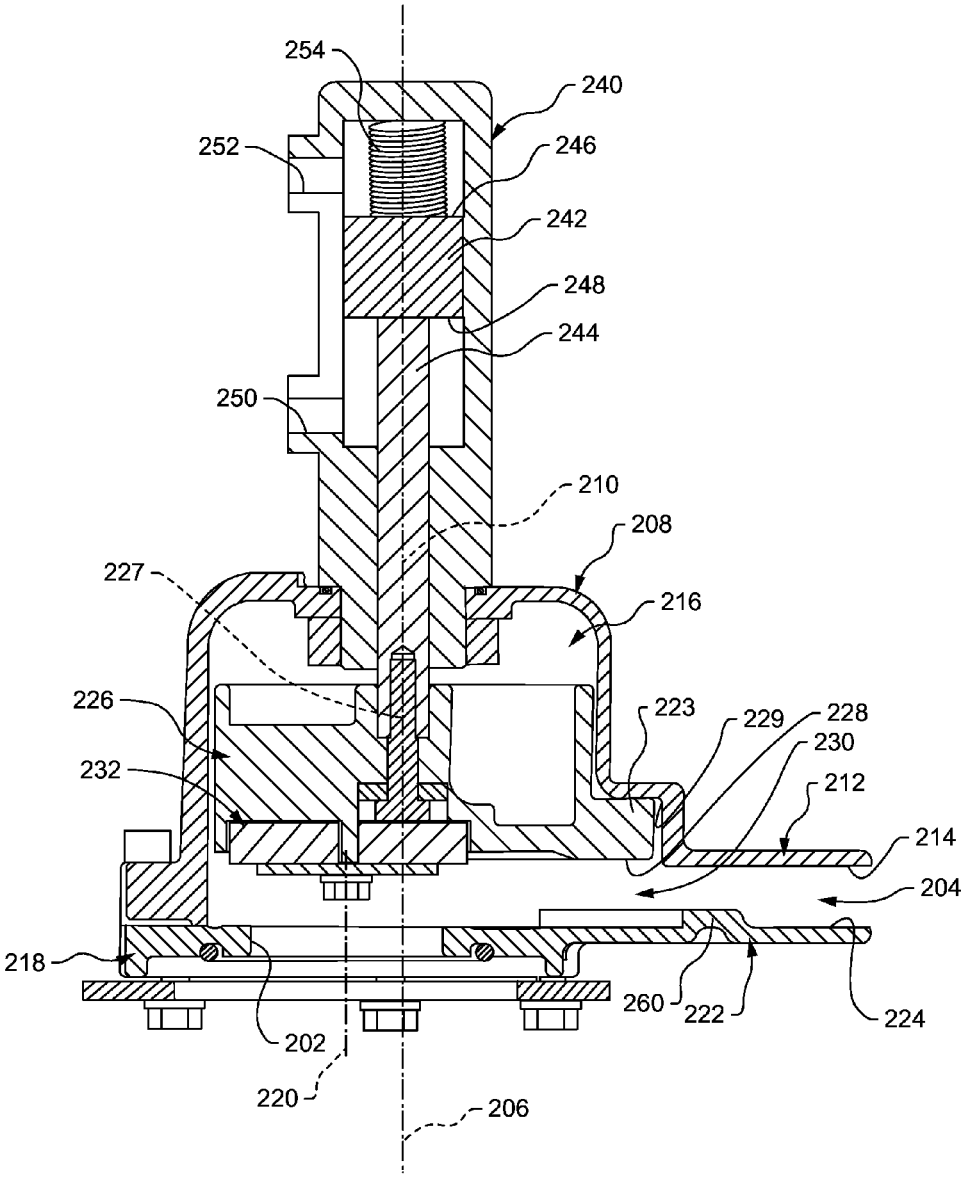
FIG. 5 is a side elevation view, in cross-section, of the spray head of FIG. 3 showing a piston of the spray head in the fully open position.
Figure 6:
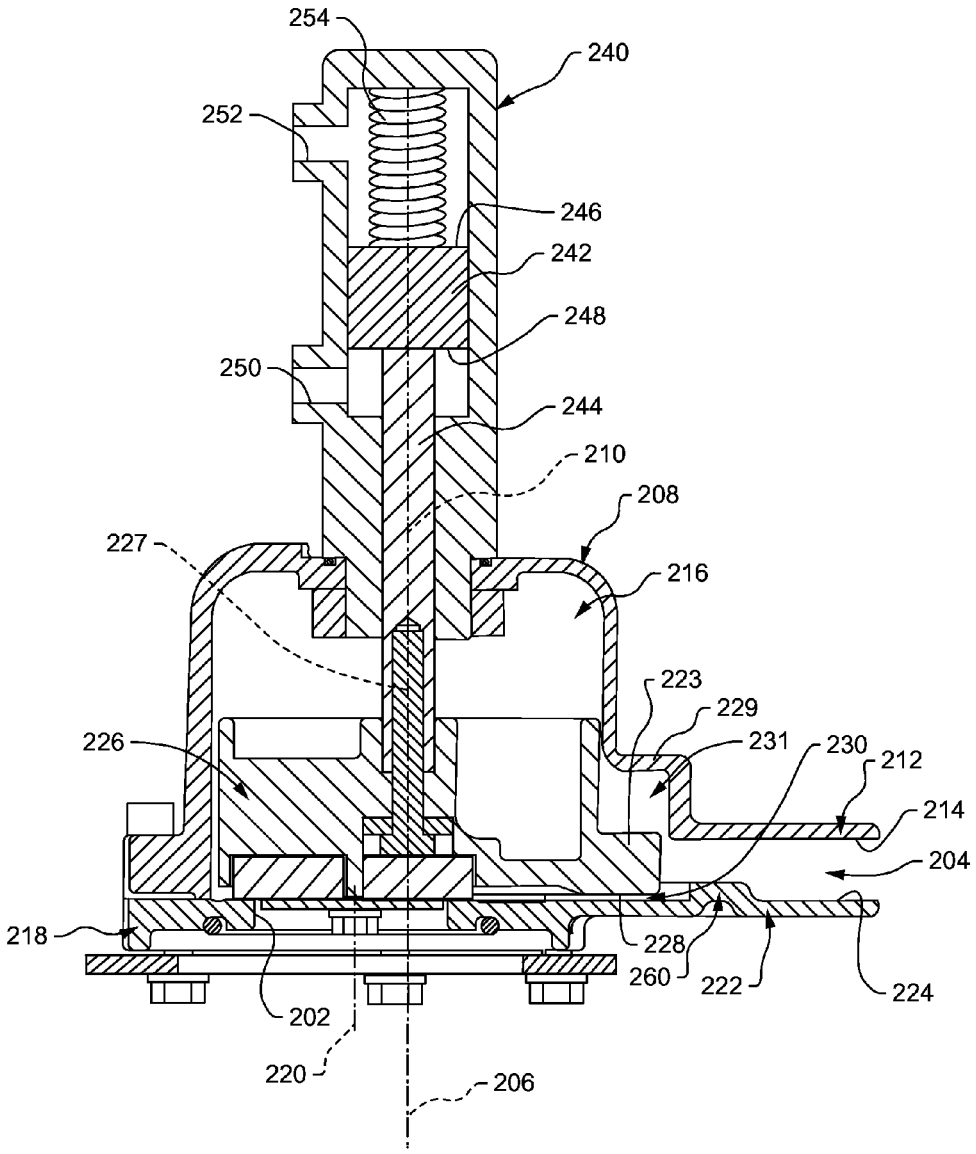
FIG. 6 is a side elevation view, in cross-section, of the spray head of FIG. 3 showing a piston of the spray head in the fully closed position.

A base 218 may be coupled to a bottom of the barrel 208 to substantially enclose the barrel chamber 216. The base 218 may define the fluid inlet passage 202 extending along an inlet axis 220. A second deflector 222 may extend outwardly from the base 218 and define a second deflector inner surface 224. As best shown in FIGS. 5 and 6, the first and second deflector inner surfaces 214, 224 may be disposed in opposed, spaced relation to define the fluid outlet passage 204. The first and second fluid deflectors 214, 224 may be configured to produce a laminar flow through the outlet passage 204 in furtherance of the laminar flow control that may be provided by the above-described specific locations of the inlet and outlet passages 202, 204 relative to the longitudinal axis 206.

Figure 4:
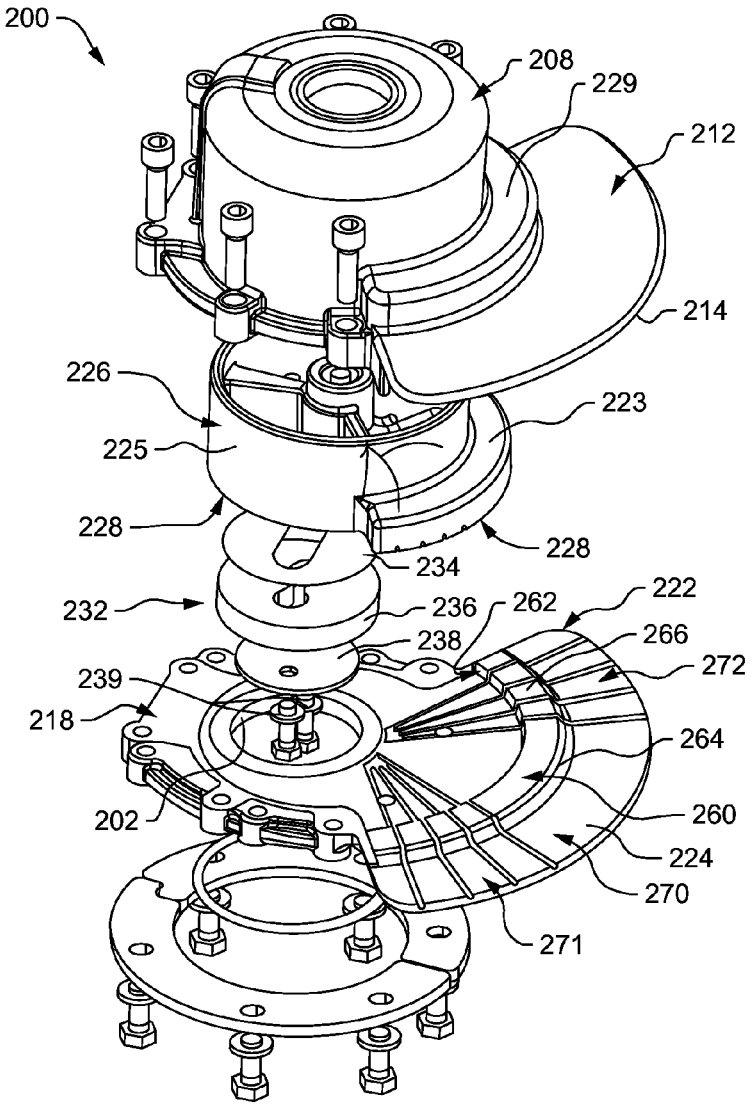
FIG. 4 is an exploded perspective view of the spray head of FIG. 3.

A piston 226 may be slidably disposed in the barrel chamber 216 to selectively control fluid flow from the inlet passage 202 to the outlet passage 204. More specifically, the piston 226 may define a piston axis 227 which, in the illustrated embodiment, is substantially coincident with the longitudinal axis 206 and the barrel axis 210. The piston 226 may include a bottom surface 228 that may be adjustably positioned relative to the base 218, thereby to define an orifice 230 having a variable cross-sectional area. The size of the orifice 230 may be adjusted by positioning the piston 226, thereby to control fluid flow from the inlet passage 202 to the outlet passage 204. As best shown in FIG. 4, the piston 226 may include a generally cylindrical piston body 225 having a dam portion 223 extending radially outwardly from the body 225. The barrel 208 may include a shoulder 229 configured to define a pocket 231 (FIG. 6) of the barrel chamber 216 sized to receive the dam portion 223.

The piston 226 may further include a seal assembly 232 coupled to the bottom surface 228. The seal assembly 232 may include a shim 234, a seal 236, and a washer 238 that are secured to the piston 226 by fasteners, such as bolts 239. The seal 236 may be formed of a material that sealingly engages a portion of the base surrounding the inlet passage 202, so that fluid flow may be stopped when the piston 226 is in the fully lowered position. The use of fasteners to secure the seal assembly 232 to the piston 226 facilitate removal and replacement of components due to wear.

Movement of the fluid piston 226 may be controlled via any suitable means known in the art, such as, e.g., with a single or double acting hydraulic cylinder or an electric motor ballscrew. Specifically, as shown in FIGS. 5 and 6, a hydraulic cylinder 240 is operatively coupled to the piston 226 to control the orifice 230. The hydraulic cylinder 240 includes a hydraulic piston 242 connected to a rod 244, which in turn is connected to the fluid piston 226. In operation, as the hydraulic piston 242 is controlled to move in a linear direction along the longitudinal axis 206, the rod 244 moves and the fluid piston 226 subsequently moves, which results in a change in size of the orifice 230.

In the embodiment shown in FIGS. 5 and 6, the hydraulic cylinder 240 is a double acting hydraulic cylinder 240. That is, the hydraulic cylinder 240 may be hydraulically controlled to move in either direction along the longitudinal axis 206. In more detail, the hydraulic piston 242 includes a head end 246 and a rod end 248. The hydraulic cylinder 240 includes a first hydraulic port 250 positioned to allow hydraulic fluid in the hydraulic cylinder 240 at the rod end 248, and a second hydraulic port 252 positioned to allow hydraulic fluid in the hydraulic cylinder 240 at the head end 246.

The hydraulic cylinder 240 may include a spring 254 disposed in the head end 246. The spring 254 may provide additional force to hold the orifice 230 in a closed position, for example when the hydraulic circuits are shut down. The spring 254 may also be used to supplement the force applied to the head end 246 of the hydraulic cylinder 240. For example, the spring 254 may be selected having a desired compression rate (e.g., force per unit of compression). The total forces applied to the head end 246 may be from a combination of hydraulic fluid supplied to the second hydraulic port 252 and the force of the spring 254, and the total forces applied to the rod end 248 may be from a combination of hydraulic fluid supplied to the first hydraulic port 250 and pressure from fluid entering the inlet passage 202. If the fluid pressure entering the inlet passage 202 is kept fairly constant, then control of the degree of opening of the orifice 230 may be attained by varying the hydraulic fluid to the first hydraulic port 250.

It is noted that the spray head 200 may be configured for control of the fluid piston 226 by use of other configurations. For example, the hydraulic cylinder 240 may be configured without the second hydraulic port 252 and the associated hydraulic components, thus relying on hydraulic pressure on the rod end 248 and spring pressure on the head end 246.

It is further noted that the spray head 200 may be configured for control by other than a hydraulic piston 242. For example, the hydraulic cylinder 240, hydraulic piston 242, and all associated hydraulic circuits and components could be replaced by electrical or mechanical actuators. As specific examples, the fluid piston 226 may be controlled by an electrical actuator such as a solenoid (not shown), or may be controlled by a mechanical actuator which may include any of a variety of cams, screws, levers, fulcrums, and the like (also not shown).

The hydraulic cylinder 240 may be fluidly isolated from the barrel chamber 216, thus isolating the fluid that passes through the orifice 230 from the hydraulic fluid in the hydraulic cylinder 240. This design offers the advantage of keeping particles and contaminants away from the components in the hydraulic cylinder 240, for example when water from retaining ponds is used for dust suppression applications.

The second deflector inner surface 224 may include a weir 260 for further facilitating desirable fluid flow characteristics through the spray head 200. In the embodiment illustrated in FIG. 4, the weir 260 may be formed integrally with the base 218. It will be appreciated, however, that the weir 260 may be formed as a separate component that is subsequently coupled to the base 218. The weir 260 may include curved inner and outer weir walls 262, 264 coupled by a weir surface 266. Accordingly, the weir surface 266 forms a raised portion of the second deflector inner surface 224, which has been found to produce a spray pattern with an increased coverage angle.

Figure 7:
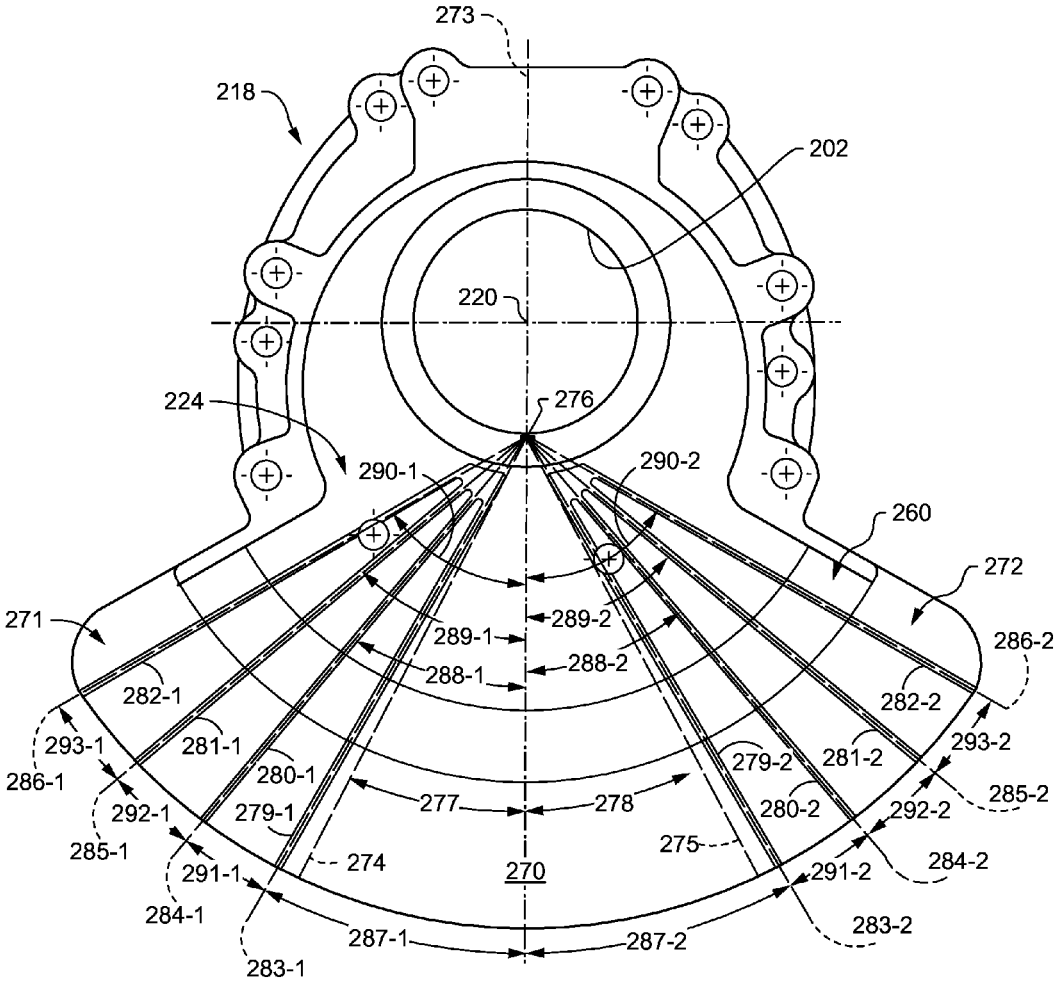
FIG. 7 is an enlarged plan view of a base of the spray head of FIG. 3.

The second deflector inner surface 224 may further include grooveless and grooved regions to promote more uniform fluid flow across the full spray pattern. As best shown in FIGS. 4 and 7, the second deflector inner surface 224 may have a deflector central region 270 that has no grooves and is disposed between first and second deflector lateral regions 271, 272. For reference purposes, a deflector centerline 273 may intersect the inlet axis 220 and extend radially outwardly therefrom to divide the second deflector inner surface into two substantially equal halves. As best shown in FIG. 7, the central region 270 borders both sides of the deflector centerline 273, while the first and second deflector lateral regions 271, 272 are disposed on opposite sides of the deflector central region 270.

In some embodiments, the deflector central region 270 may be bounded by boundary lines provided as references. In the embodiment illustrated in FIG. 7, first and second deflector central region boundary lines 274, 275 extend radially from a deflector vertex point 276 and are disposed on opposite sides of the deflector centerline 273. The deflector vertex point 276 may be disposed on the deflector centerline 273 and may identify the point at which the boundary lines 274, 275 intersect. Relative to the deflector centerline 273, the first deflector central region boundary line 274 may form a first deflector boundary angle 277 and the second central region deflector boundary line 275 may form a second deflector boundary angle 278. In the exemplary embodiment, the first and second deflector boundary angles 277, 278 are substantially equal, and are each at least approximately 20 degrees.

Each of the first and second deflector lateral regions 271, 272 may be formed with at least one groove. As best shown in FIGS. 4 and 7, the first deflector lateral region 271 may be formed with a first deflector groove 279-1, a second deflector groove 280-1, a third deflector groove 281-1, and a fourth deflector groove 282-1. Similarly, the second deflector lateral region 272 may be formed with a first deflector groove 279-2, a second deflector groove 280-2, a third deflector groove 281-2, and a fourth deflector groove 282-2. Each of the deflector grooves may extend along an associated deflector groove path. For example, first deflector groove paths 283-1, 283-2, second deflector groove paths 284-1, 284-2, third deflector groove paths 285-1, 285-2, and fourth deflector groove paths 286-1, 286-2 may be associated with the deflector grooves noted above, as shown in FIG. 7. Each deflector groove path may be oriented substantially radially relative to the inlet passage 202. In the illustrated embodiments, each deflector groove path is oriented to intersect the deflector vertex point 276.

The deflector groove paths may be oriented at different angles within the first and second deflector lateral regions 271, 272. In the embodiment illustrated in FIG. 7, for example, the first deflector groove paths 283-1, 283-2 are disposed relative to the deflector centerline 273 to form respective first deflector groove path angles 287-1, 287-2. Similarly, the second deflector groove paths 284-1, 284-2 form second deflector groove path angles 288-1, 288-2, the third deflector groove paths 285-1, 285-2 form third deflector groove path angles 289-1, 289-2, and the fourth deflector groove paths 286-1, 286-2 form fourth deflector groove path angles 290-1, 290-2, all relative to the deflector centerline 273, wherein the first, second, third, and fourth deflector groove path angles may be different from one another. In some embodiments, the first deflector groove path angles 287-1, 287-2 may be at least approximately 25 degrees to accommodate the grooveless central region 270.

Still further, the angles between adjacent groove paths may be uniformly distributed throughout each of the first and second deflector lateral regions 271, 272 to promote even distribution of fluid flow. The first and second deflector groove paths 283-1, 283-2, 284-1, 284-2 in each of the first and second deflector lateral regions 271, 272 may be adjacent and define therebetween first deflector adjacent angles 291-1, 291-2. Similarly, the second and third deflector groove paths 284-1, 284-2, 285-1, 285-2 may be adjacent and define therebetween second deflector adjacent angles 292-1, 292-2. Finally, the third and fourth deflector groove paths 285-1, 285-2, 286-1, 286-2 may be adjacent and define therebetween third deflector adjacent angles 293-1, 293-2. The first, second, and third deflector adjacent angles 291-1, 291-2, 292-1, 292-2, 293-1, 293-2 may be substantially equal. For example, each of the adjacent angles may be approximately 10 degrees.

The grooves formed in the second deflector inner surface 224 may have a maximum width and depth configured to promote additional fluid flow to the first and second deflector lateral regions 271, 272. For example, each groove may have a groove width of approximately 2 millimeters and a groove depth of approximately 1 millimeter, however other dimensions may be used. The grooves may traverse through the weir 260, if provided. In some embodiments, the grooves may be configured to have a different depth as they traverse the weir 260. That is, the portion of each groove that traverses the weir 260 may have a smaller or larger groove depth than the other portions of the groove. Alternatively, the weir may be grooveless, in which case the weir 260 interrupts each groove. The grooves may be configured to have cross-sectional shapes that are semi-circular, rectangular, square, or other profile shapes.

Figure 8:
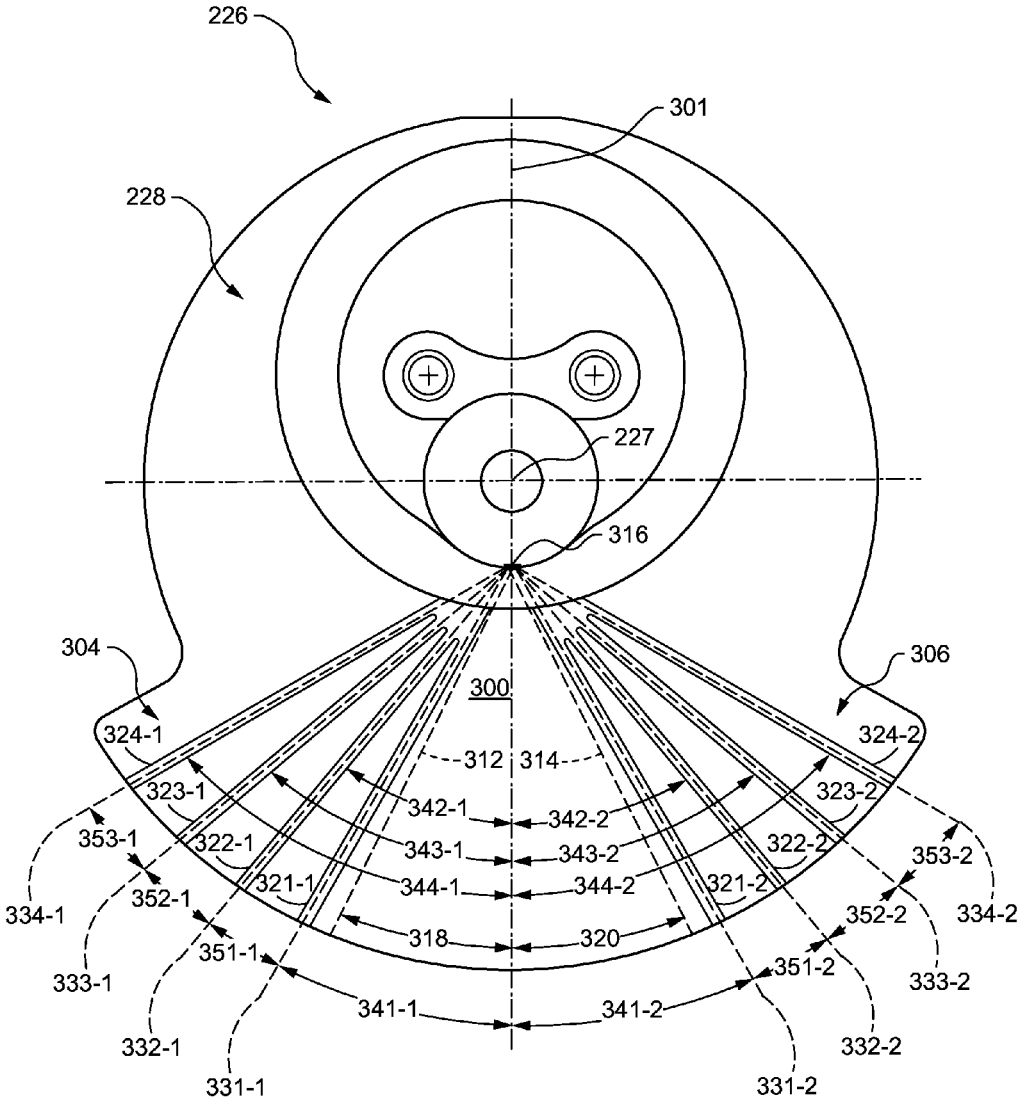
FIG. 8 is an enlarged bottom view of a piston of the spray head of FIG. 3.

To further promote uniform distribution of fluid flow, the piston bottom surface 228 may also include grooveless and grooved regions. As best shown in FIGS. 4 and 8, the piston bottom surface 228 may define a piston central region 300 that has no grooves and is disposed between first and second piston lateral regions 304, 306. For reference purposes, a piston centerline 301 may intersect the piston axis 227 and extend radially outwardly therefrom to divide the piston bottom surface 228 into two substantially equal halves. As best shown in FIG. 8, the piston central region 300 borders both sides of the piston centerline 301, while the first and second piston lateral regions 304, 306 are disposed on opposite sides of the piston central region 300.

In some embodiments, the piston central region 300 may be considered to be bounded by boundary lines provided as a reference. In the embodiment illustrated in FIG. 8, first and second piston central region boundary lines 312, 314 extend radially from a piston vertex point 316 and are disposed on opposite sides of the piston centerline 301. The piston vertex point 316 may be disposed on the piston centerline 301 and may identify the point at which the boundary lines 312, 314 intersect. Relative to the piston centerline 301, the first piston central region boundary line 312 may form a first piston boundary angle 318 and the second central region piston boundary line 314 may form a second piston boundary angle 320. In the exemplary embodiment, the first and second piston boundary angles 318, 320 are substantially equal, and are each at least approximately 20 degrees.

Each of the first and second piston lateral regions 304, 306 may be formed with at least one groove. As best shown in FIGS. 4 and 8, the first piston lateral region 304 may be formed with a first piston groove 321-1, a second piston groove 322-1, a third piston groove 323-1, and a fourth piston groove 324-1. Similarly, the second piston lateral region 306 may be formed with a first piston groove 321-2, a second piston groove 322-2, a third piston groove 323-2, and a fourth piston groove 324-2. Each of the piston grooves may extend along an associated piston groove path. For example, first piston groove paths 331-1, 331-2, second piston groove paths 332-1, 332-2, third piston groove paths 333-1, 333-2, and fourth piston groove paths 334-1, 334-2 may be associated with the piston grooves noted above, as shown in FIG. 8. Each piston groove path may be oriented substantially radially relative to the piston axis 227. In the illustrated embodiments, each piston groove path is oriented to intersect the piston vertex point 316.

The piston groove paths may be oriented at different angles within the first and second piston lateral regions 304, 306. In the embodiment best illustrated in FIG. 8, for example, the first piston groove paths 331-1, 331-2 are disposed relative to the piston centerline 301 to form respective first piston groove path angles 341-1, 341-2. Similarly, the second piston groove paths 332-1, 332-2 form second piston groove path angles 342-1, 342-2, the third piston groove paths 333-1, 333-2 form third piston groove path angles 343-1, 343-2, and the fourth piston groove paths 334-1, 334-2 form fourth piston groove path angles 344-1, 344-2, all relative to the piston centerline 301, wherein the first, second, third, and fourth piston groove path angles may be different from one another. In some embodiments, the first piston groove path angles 341-1, 341-2 may be at least approximately 25 degrees to accommodate the grooveless central region 300.

Still further, the angles between adjacent groove paths may be uniformly distributed throughout each of the first and second piston lateral regions 304, 306 to promote even distribution of fluid flow. The first and second piston groove paths 331-1, 331-2, 332-1, 332-2 in each of the first and second piston lateral regions 304, 306 may be adjacent and define therebetween first piston adjacent angles 351-1, 351-2. Similarly, the second and third piston groove paths 332-1, 332-2, 333-1, 333-2 may be adjacent and define therebetween second piston adjacent angles 352-1, 352-2. Finally, the third and fourth piston groove paths 333-1, 333-2, 334-1, 334-2 may be adjacent and define therebetween third piston adjacent angles 353-1, 353-2. The first, second, and third piston adjacent angles 351-1, 351-2, 352-1, 352-2, 353-1, 353-2 may be substantially equal. For example, each of the adjacent angles may be approximately 10 degrees.

The grooves formed in the piston bottom surface 228 may have a maximum width and depth configured to promote additional fluid flow to the first and second piston lateral regions 304, 306. For example, each groove may have a groove width of approximately 2 millimeters and a groove depth of approximately 1 millimeter, however other dimensions may be used. The grooves may be configured to have cross-sectional shapes that are semi-circular, rectangular, square, or other profile shapes.

In the illustrated embodiments, the grooves formed in the piston 226 are shown as generally mirroring the grooves formed in the second deflector inner surface 224. It will be appreciated, however, that the piston 226 and second deflector inner surface 224 may have different numbers of grooves disposed at different angles. Furthermore, only one of the piston 226 and second deflector inner surface 224 may have grooves while still benefiting from the advantages disclosed herein.

INDUSTRIAL APPLICABILITY

Fluid distributing systems and methods are disclosed that provide a more uniform distribution of fluid flow across the entire fluid distribution pattern. More specifically, grooves may be formed in the lateral regions of the second deflector inner surface 224 and/or the piston bottom surface 228. As a result, the lateral regions of the second deflector inner surface 224 and/or piston bottom surface 228 have a reduced back pressure, thereby facilitating more fluid flow to the lateral portions of the fluid spray pattern.

The present disclosure provides a mobile fluid distribution system 100 and method which offers many advantages, among which includes providing control of fluid distribution over a desired area, in particular control of an amount of fluid distributed over a desired unit of area under varying conditions. Maintaining a constant fluid pressure while varying the flow rate through individual spray heads 200 provides more precise control of fluid distribution and the capability for a number of specialized flow control modes.

Test data indicates that the spray head 200 provides a more uniform distribution of fluid flow across the entire spray path range. Provided below is test data obtained by pumping fluid through two different spray heads: (1) a first spray head having no grooves in the deflector inner surface or piston bottom surface; and (2) a second spray head similar to the spray head 200 described above, in which grooves were formed in lateral regions of the second deflector inner surface 224.

Sets of flow distribution data were obtained for each spray head under varying operating conditions. More specifically, the orifice size was incrementally changed between 4-16 mm, and the fluid supply pressure was varied between 20-40 psi. A fluid distribution pattern spanning 180° was observed exiting the spray heads, and the pattern was separated into six distribution zones for comparative analysis. Each distribution zone spanned 30°, so that a first distribution zone covered 0-30°, a second distribution zone covered 30-60°, a third distribution zone covered 60-90°, a fourth distribution zone covered 90-120°, a fifth distribution zone covered 120-150°, and a sixth distribution zone covered 150-180°. The first and second distribution zones may generally correspond to the first deflector lateral region 271, the third and fourth distribution zones may generally correspond to the deflector central region 270, and the fifth and sixth distribution zones may generally correspond to the second deflector lateral region 272.

A visual representation of each spray pattern produced by each of the operating conditions was recorded and then modeled to obtain a fluid distribution index associated with each distribution zone. The fluid distribution index, therefore, is indicative of a rate of fluid flow associated with each distribution zone, and may be stated as a percentage ranging between 0 and 100%. An average of all of the fluid distribution indexes determined under the various operating conditions was then obtained and is presented below in table 1:

TABLE 1

Fluid Distribution Data

| Distribution Zone | Average Fluid Distribution Index—Grooveless Spray Head | Average Fluid Distribution Index—Spray Head with Grooves |
|---|---|---|
| 1 (0-30°) | 20.5% | 41.2% |
| 2 (30-60°) | 44.0% | 44.8% |
| 3 (60-90°) | 58.8% | 46.9% |
| 4 (90-120°) | 59.3% | 48.9% |
| 5 (120-150°) | 40.0% | 47.3% |
| 6 (150-180°) | 12.6% | 44.3% |

Based on the foregoing data, a maximum distribution variance may be determined for each of the tested spray heads. The maximum distribution variance is the difference between the highest and lowest average fluid distribution indexes for a given spray head, and is indicative of how uniformly fluid is distributed across the spray pattern. For example, the above data indicates that the Grooveless Spray Head has a maximum distribution variance of 46.7% (59.3%-12.6%) and the Spray Head with Grooves has a maximum distribution variance of 7.7% (48.9%-41.2%). Based on this data, applicants have determined that the Spray Head with Grooves produces a maximum distribution variance of less than approximately 10%.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A spray head for a fluid distribution system comprising:

a base defining a fluid inlet passage extending along an inlet axis;

a barrel coupled to the base and defining a barrel chamber extending along a barrel axis;

a first deflector extending outwardly from the barrel and defining a first deflector inner surface;

a second deflector extending outwardly from the base and defining a second deflector inner surface, wherein the first and second deflector inner surfaces are disposed in opposed, spaced relation to define a fluid outlet passage;

a piston slidably disposed in the barrel chamber and having a bottom surface;

an orifice defined between the piston bottom surface the second deflector inner surface having a cross-sectional area that varies with piston position to control fluid flow from the fluid inlet passage to the fluid outlet passage;

the second deflector inner surface defining a grooveless deflector central region disposed between first and second deflector lateral regions, each of the first and second deflector lateral regions including at least a first deflector groove extending along a first deflector groove path oriented substantially radially relative to the inlet passage.

2. The spray head of claim 1, further including:

a deflector centerline oriented to intersect the inlet axis and to divide the second deflector inner surface into two substantially equal halves; and a deflector vertex point disposed on the deflector centerline.

3. The spray head of claim 2, in which each first deflector groove path is oriented to intersect the deflector vertex point and form a first deflector groove path angle relative to the deflector centerline, and the first deflector groove path angle is at least approximately 25 degrees.

4. The spray head of claim 3, in which each of the first and second deflector lateral regions further includes a second deflector groove extending along a second deflector groove path oriented to intersect the deflector vertex point and form a second deflector groove path angle relative to the deflector centerline, and the second deflector groove path angle is different from the first deflector groove path angle.

5. The spray head of claim 4, in which each of the first and second deflector lateral regions further includes a third deflector groove extending along a third deflector groove path oriented to intersect the deflector vertex point and form a third deflector groove path angle relative to the deflector centerline, and the third deflector groove path angle is different from the first and second deflector groove path angles.

6. The spray head of claim 5, in which each of the first and second deflector lateral regions further includes a fourth deflector groove extending along a fourth deflector groove path oriented to intersect the deflector vertex point and form a fourth deflector groove path angle relative to the deflector centerline, and the fourth deflector groove path angle is different from the first, second, and third deflector groove path angles.

7. The spray head of claim 6, in which the first and second deflector groove paths in each of the first and second deflector lateral regions are adjacent and define therebetween a first deflector adjacent angle, in which the second and third deflector groove paths in each of the first and second deflector lateral regions are adjacent and define therebetween a second deflector adjacent angle, in which the third and fourth deflector groove paths in each of the first and second deflector lateral regions are adjacent and define therebetween a third deflector adjacent angle, and in which the first, second, and third deflector adjacent angles are substantially equal.

8. The spray head of claim 2, in which the deflector central region is bounded by first and second deflector central region boundary lines disposed on opposite sides of the deflector centerline, wherein the first central region deflector boundary line extends radially from the deflector vertex point and forms a first deflector boundary angle relative to the deflector centerline, the second central region deflector boundary line extends radially from the deflector vertex point and forms a second deflector boundary angle relative to the deflector centerline, and in which the first and second deflector boundary angles are substantially equal.

9. The spray head of claim 8, in which each of the first and second deflector boundary angles are at least approximately 20 degrees.

10. The spray head of claim 1, further including a weir disposed on the second deflector inner surface, the weir having an inner weir surface spaced from and opposing the orifice, in which each of the first deflector grooves traverses the weir.

11. The spray head of claim 10, in which each of the first deflector grooves has a first deflector groove depth, and in which the first deflector groove depth is different as the first deflector groove traverses the weir.

12. The spray head of claim 1, in which:

the piston defines a piston axis substantially parallel to the inlet axis;

a piston centerline oriented to intersect the piston axis and to divide the piston bottom surface into two substantially equal halves;

a piston vertex point disposed on the piston centerline; and the piston bottom surface including a grooveless piston central region disposed between first and second piston lateral regions, each of the first and second piston lateral regions including at least a first piston groove extending along a first piston groove path oriented substantially radially relative to the piston vertex point.

13. The spray head of claim 1, in which the inlet axis is substantially parallel to the barrel axis, and in which the fluid outlet passage extends substantially perpendicular to inlet axis.

14. A deflector assembly for use with a fluid distributing spray head having a fluid inlet passage extending along an inlet axis, the deflector assembly comprising:

a first deflector extending outwardly from the inlet axis and defining a first deflector inner surface;

a second deflector extending outwardly from the inlet axis and defining a second deflector inner surface, wherein the first and second deflector inner surfaces are disposed in opposed, spaced relation to define a fluid outlet passage, the second deflector inner surface further including:

a grooveless deflector central region;

first and second deflector lateral regions disposed on opposite sides of the deflector central region;

at least a first deflector groove disposed in each of the first and second deflector lateral regions, each of the first deflector grooves extending along a first deflector groove path oriented substantially radially relative to the inlet passage of the spray head.

15. The deflector assembly of claim 14, in which the second deflector inner surface further includes:

a deflector centerline oriented to intersect the inlet axis and to divide the second deflector inner surface into two substantially equal halves; and a deflector vertex point disposed on the deflector centerline, wherein each first deflector groove path is oriented to intersect the deflector vertex point and form a first deflector groove path angle relative to the deflector centerline.

16. The deflector assembly of claim 15, in which each of the first and second deflector lateral regions further includes:

a second deflector groove extending along a second deflector groove path oriented to intersect the deflector vertex point and form a second deflector groove path angle relative to the deflector centerline, in which the second deflector groove path angle is different from the first deflector groove path angle;

a third deflector groove extending along a third deflector groove path oriented to intersect the deflector vertex point and form a third deflector groove path angle relative to the deflector centerline, in which the third deflector groove path is different from the first and second deflector groove path angles; and a fourth deflector groove extending along a fourth deflector groove path oriented to intersect the deflector vertex point and form a fourth deflector groove path angle relative to the deflector centerline, in which the fourth deflector groove path angle is different from the first, second, and third deflector groove path angles.

17. The deflector assembly of claim 16, in which the first and second deflector groove paths in each of the first and second deflector lateral regions are adjacent and define therebetween a first deflector adjacent angle, in which the second and third deflector groove paths in each of the first and second deflector lateral regions are adjacent and define therebetween a second deflector adjacent angle, in which the third and fourth deflector groove paths in each of the first and second deflector lateral regions are adjacent and define therebetween a third deflector adjacent angle, and in which the first, second, and third deflector adjacent angles are substantially equal.

18. The deflector assembly of claim 15, in which the deflector central region is bounded by first and second deflector central region boundary lines disposed on opposite sides of the deflector centerline, wherein the first central region deflector boundary line extends radially from the deflector vertex point and forms a first deflector boundary angle relative to the deflector centerline, the second central region deflector boundary line extends radially from the deflector vertex point and forms a second deflector boundary angle relative to the deflector centerline, and in which the first and second deflector boundary angles are substantially equal.

19. A spray head for a fluid distribution system comprising:

a base defining a fluid inlet passage extending along an inlet axis;

a barrel coupled to the base and defining a barrel chamber extending along a barrel axis;

a first deflector extending outwardly from the barrel and defining a first deflector inner surface;

a second deflector extending outwardly from the base and defining a second deflector inner surface, wherein the first and second deflector inner surfaces are disposed in opposed, spaced relation to define a fluid outlet passage;

a piston slidably disposed in the barrel chamber and having a bottom surface;

an orifice defined between the piston bottom surface the second deflector inner surface having a cross-sectional area that varies with piston position to control fluid flow from the fluid inlet passage to the fluid outlet passage; and the second deflector inner surface defining a grooveless deflector central region disposed between first and second deflector lateral regions, each of the first and second deflector lateral regions including at least a first deflector groove extending along a first deflector groove path oriented substantially radially relative to the inlet passage;

wherein a fluid spray pattern defined by the spray head includes a central distribution zone associated with the deflector central region and having a central distribution zone flow index, a first lateral distribution zone associated with the first deflector lateral region and having a first deflector distribution zone flow index, and a second lateral distribution zone associated with the second deflector lateral region and having a second deflector distribution zone flow index, in which a maximum distribution variance between the central distribution zone flow index and the first and second deflector distribution zone flow indices is less than approximately 10%.

20. The spray head of claim 19, further including:

a deflector centerline oriented to intersect the inlet axis and to divide the deflector inner surface into two substantially equal halves; and a deflector vertex point disposed on the deflector centerline;

in which each first deflector groove path is oriented to intersect the deflector vertex point and form a first deflector groove path angle relative to the deflector centerline, the first deflector groove path angle being at least approximately 25 degrees.

* * * * *